US010957499B2

(12) United States Patent
Sumi et al.

(10) Patent No.: US 10,957,499 B2
(45) Date of Patent: Mar. 23, 2021

(54) PUSH-BUTTON FOR GAME MACHINE

(71) Applicant: Omron Corporation, Kyoto (JP)

(72) Inventors: Masaaki Sumi, Gifu (JP); Hiroyuki Onitsuka, Gifu (JP); Takehiro Agata, Aichi (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 16/554,167

(22) Filed: Aug. 28, 2019

(65) Prior Publication Data

US 2020/0090882 A1 Mar. 19, 2020

(30) Foreign Application Priority Data

Sep. 13, 2018 (JP) ..... JP2018-171785

(51) Int. Cl.
*G07F 17/32* (2006.01)
*H01H 13/06* (2006.01)

(52) U.S. Cl.
CPC ..... *H01H 13/06* (2013.01); *G07F 17/3209* (2013.01)

(58) Field of Classification Search
CPC ..... G07F 17/3209; H01H 13/06
See application file for complete search history.

(56) References Cited

U.S. PATENT DOCUMENTS 5,421,659 A * 6/1995 Liang ..... B41J 5/10 200/306
5,810,491 A * 9/1998 Muller ..... H01H 13/70 400/472
6,054,939 A * 4/2000 Wei ..... H01H 13/70 200/513
6,156,983 A * 12/2000 Chen ..... H01H 13/70 200/302.1
6,644,874 B2 * 11/2003 Tsai ..... G06F 1/1616 200/302.1
7,365,281 B2 * 4/2008 Yamaguchi ..... G06F 3/0202 200/302.1
2013/0143660 A1 * 6/2013 Taniguchi ..... G07F 17/3209 463/37
2014/0179429 A1 * 6/2014 Okazaki ..... G07F 17/3209 463/31
2015/0213976 A1 * 7/2015 Okazaki ..... G07F 17/3216 463/31
2016/0335844 A1 * 11/2016 Onoyama ..... H01H 13/86

FOREIGN PATENT DOCUMENTS

JP 6015241 B2 10/2016

* cited by examiner

*Primary Examiner* — Omkar A Deodhar
*Assistant Examiner* — Shauna-Kay Hall
(74) *Attorney, Agent, or Firm* — Osha Bergman Watanabe & Burton LLP

(57) ABSTRACT

To achieve a push-button for a game machine, capable of maintaining excellent waterproof performance and having excellent operability even when a large amount of liquid is spilled, or even when liquid is spilled while the push-button is pressed. A push-button for a game machine includes: an elastic body provided in a flange shape integrally with a key top with an outer periphery of the key top and having an outer end held between a base and a bezel; and a discharge path that communicates with a space partitioned by the key top, the bezel, and the elastic body and discharges liquid having entered the space to the outside.

15 Claims, 11 Drawing Sheets

PUSH-BUTTON FOR GAME MACHINE

CROSS-REFERENCE TO RELATED APPLICATION

This application is based on Japanese Patent Application No. 2018-171785 filed with the Japan Patent Office on Sep. 13, 2018, the entire contents of which are incorporated herein by reference.

FIELD

The present invention relates to a push-button for a game machine and more specifically relates to a waterproof structure of a push-button for a game machine.

BACKGROUND

A plurality of game machines such as slot machines produced by various game machine manufacturers are installed in game facilities such as casinos, and a player selects a favorite game machine to play a game. The game machine is thus required to be so appealing as to attract and incline the player to play a game.

In the game machine, an operation unit is provided at a position conspicuous in the appearance of the front (front surface) faced by the player, and the operation unit is a portion directly operated by the player. Therefore, the operation unit is an important portion that appeals the game machine to the player, and a push-button (a push-button for the game machine) disposed on the operation unit is also an important component to appeal the game machine.

As a configuration for making the operation unit and the push-button conspicuous, there has been a configuration where a display device is disposed on the operation unit, and a transparent push-button is placed on the display device so that an image displayed through the push-button is visually recognized. In addition, there is also a method of causing the push-button to emit light by using a display element.

Meanwhile, the operation unit of the game machine as thus described has a problem that liquid such as a beverage may be spilled thereon during the game, as a problem that the operation unit cannot avoid due to being the operation unit of the game machine. When the spilled liquid enters the inside of the push-button, electrical components such as a detection element for detecting the pressing and a light emitting element get wet to cause a failure. In addition, when the liquid enters a visible recognition area where the display image is viewed through the push-button, the display image may become difficult to see.

As a waterproofing measure technique for such a push-button disposed in the game machine, the applicant of the present application has filed a configuration in which liquid having entered the inside of the push-button is discharged outside through the upper surface of a sheet made of an elastic member (Japanese Patent No. 6015241).

The above waterproofing measure technique described in Japanese Patent No. 6015241 is a breakthrough technology in which the spilled liquid is discharged to the outside through a sheet, but there is still room for improvement.

One of the problems is that when a large amount of liquid has entered, the liquid may overflow from a discharge path on the sheet and enter an unexpected place. In addition, no consideration is given to the spilling of the liquid while the push-button is pressed.

SUMMARY

It is an object of one aspect of the present invention to achieve a push-button for a game machine, capable of maintaining excellent waterproof performance and having excellent operability even when a large amount of liquid is spilled, or even when liquid is spilled while the push-button is pressed.

In order to solve the above problems, a push-button for a game machine according to one aspect of the present invention includes: a base; a button body supported by the base so as to be pressable; a spring component disposed between the base and the button body and configured to return the pressed button body; a frame having, inside, an opening through which a central portion of the button body moves in a pressing direction, the frame covering an outer periphery of the button body from an opposite side of the base and being fixed to the base; an elastic body provided in a flange shape integrally with the button body on the outer periphery of the button body and having an outer end held between the base and the frame; and a discharge path configured to communicate with a space partitioned by the button body, the frame, and the elastic body, the discharge path being configured to discharge liquid entering the space to the outside.

With the above configuration, the elastic body prevents the insertion of the liquid into the base, the elastic body provided in the flange shape integrally on the outer periphery of the button body and having an outer end held between the base and the frame. The liquid enters from between the outer periphery of the button body and the frame. However, the outer end of the elastic body held between the base and the frame functions as a waterproof packing, to prevent the liquid from entering the inside of the base through the gap between the base and the frame. Further, since the elastic body is formed integrally on the button body, the liquid does not enter the inside of the base through the joint between the elastic body and the button body.

Accordingly, even when an electrical component is disposed inside the base, it is possible to prevent the electrical component from contacting the liquid. In addition, even when the display device is installed on the back side of the push-button for the game machine and the push-button for the game machine is configured to make the image of the display device visible through the button body, it is possible to prevent the liquid from entering the visible recognition area and impairing the visibility of the image.

By the elastic body blocking the entry path of the liquid into the base as described above, it is possible to prevent the liquid from entering the inside of the base. However, the liquid remaining in the space partitioned by the button body, the frame, and the elastic body may reduce the operability of the button body. This is, for example, a case where the liquid contains sugar, and the liquid becomes viscous to inhibit the operability of the button body.

Therefore, the above configuration further includes the discharge path that communicates with the space partitioned by the button body, the frame, and the elastic body, and discharges liquid having entered the space to the outside. As a result, the liquid is discharged outside without being accumulated in the space partitioned by the button body, the frame and the elastic body via the discharge path, so that it is possible to prevent a decrease in operability.

In the push-button for the game machine according to one aspect of the present invention, the discharge path may include a recess formed in an area in the frame, the area being in contact with the outer end, and a groove portion formed in a location in the base, the frame, or both, the location corresponding to the recess.

With the above configuration, it is possible to facilitate the formation of the discharge path that communicates with the space partitioned by the button body, the frame, and the elastic body, and discharges the liquid having entered the space to the outside.

The push-button for the game machine according to one aspect of the present invention may further include: a first rib formed on a surface of the outer end on the frame side; and a first rib receiving groove that is formed in the frame and in which the first rib is fitted.

With the above configuration, the first rib formed on the frame-side surface of the outer end that functions as the waterproof packing is fitted to the first rib receiving groove formed in the frame, so that the shape of the first rib is maintained even when the shape of the elastic body is deformed in response to the pressing of the button body. As a result, even when the elastic body deforms in response to the pressing of the button body, the stable waterproofness can be maintained.

The push-button for the game machine according to one aspect of the present invention may further include: a second rib formed on a surface of the outer end on the base side; and a second rib receiving groove that is formed in the base and in which the second rib is fitted.

With the above configuration, the second rib formed on the base-side surface of the outer end that functions as the waterproof packing is fitted to the second rib receiving groove formed in the base, so that the shape of the second rib is maintained even when the shape of the elastic body is deformed in response to the pressing of the button body. As a result, even when the elastic body deforms in response to the pressing of the button body, the stable waterproofness can be maintained. By providing the ribs on the base side as well as on the frame side, the waterproofness can further be enhanced.

The push-button for the game machine according to one aspect of the present invention may further include a click generator formed integrally on the elastic body and configured to give a click feeling by deforming upon pressing of the button body.

The click generator that gives a click feeling by deforming upon the pressing of the button body is formed of an elastic member. Thus, integrally forming the click generator on the elastic body as in the above configuration enables cost reduction and reduction in the number of components.

The push-button for the game machine according to one aspect of the present invention may further include: a pressing detector which is disposed in the pressing direction of the button body and detects that pressing of the button body; and a press portion formed integrally on the elastic body and contacting a sensor of the pressing detector upon the pressing of the button body.

In the configuration in which the pressing detector detects the pressing of the button body, the press portion is formed of the elastic member, the press portion being provided on the button body side and contacting the pressing detector upon the pressing of the button body. Thus, integrally forming the press portion on the elastic body as in the above configuration enables cost reduction and reduction in the number of components.

The push-button for the game machine according to one aspect of the present invention may further include, on the frame-side surface of the elastic body, a slope that becomes lower toward the discharge path.

With the above configuration, the slope can guide to a discharge port the liquid having entered the space defined by the button body, the frame, and the elastic body, the slope being provided on the frame-side surface of the elastic body and becoming lower toward the discharge path. It is thereby possible to make the liquid difficult to remain.

The push-button for the game machine according to one aspect of the present invention may further include an air hole formed on the base and configured to allow air to flow into and out of the base.

The elastic body is provided integrally on the outer periphery of the button body, and the outer end thereof is held between the base and the frame to function as a waterproof packing, so that it is possible to almost reliably close the entry path of the liquid into the base. However, when the button body is returned, air is sucked through any gap into the base with a strong force due to the high airtightness, and if a portion with a weak sealing ability is generated due to aging, there is a possibility that the liquid may be sucked with the air from that portion.

With the above configuration, since the air hole is provided in the base to allow air to flow into and out of the base, even when a portion with a weak sealing ability is generated due to aging, it is possible to effectively prevent the suction of the liquid by pressure when the button body is returned. In addition, the button body smoothly returns.

According to one aspect of the present invention, it is possible to achieve a push-button for a game machine, capable of maintaining excellent waterproof performance and having excellent operability even when a large amount of liquid is spilled, or even when liquid is spilled while the push-button is pressed.

DETAILED DESCRIPTION

First Embodiment

Hereinafter, an embodiment according to one aspect of the present disclosure (hereinafter also referred to as "the embodiment") will be described with reference to the drawings. As one mode of the push-button for the game machine according to the present disclosure, the embodiment exemplifies a push-button for a game machine which is mounted on a game machine such as a slot machine.

§ 1 Application Example

Figure 1A:
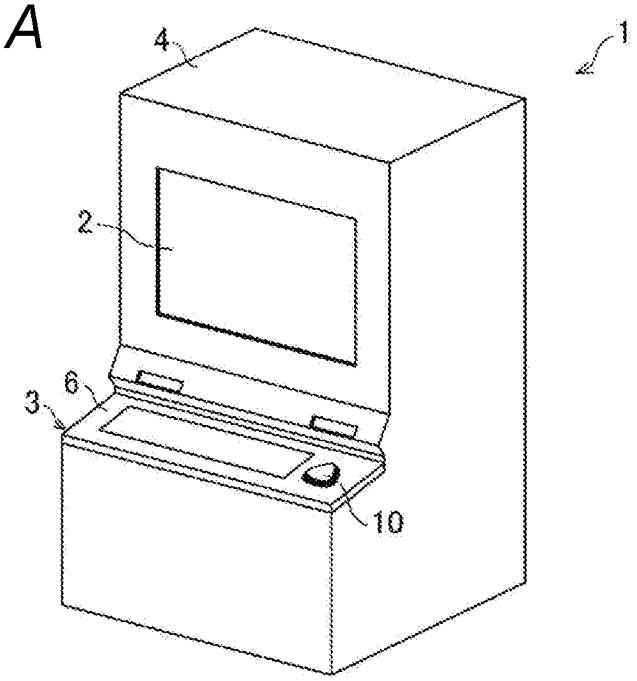
FIG. 1A is a perspective view of a slot machine mounted with a push-button according to a first embodiment of the present invention.

First, with reference to FIGS. 1A to 2C and 5, a description will be given of an example in which a push-button 10 for a game machine (hereinafter, push-button 10) is applied. FIG. 1A is a perspective view of a slot machine 1 on which the push-button 10 is mounted, FIG. 1B is a top view of the slot machine 1, and FIG. 10 is a sectional view taken along a line A-A of FIG. 1B.

Figure 1B:
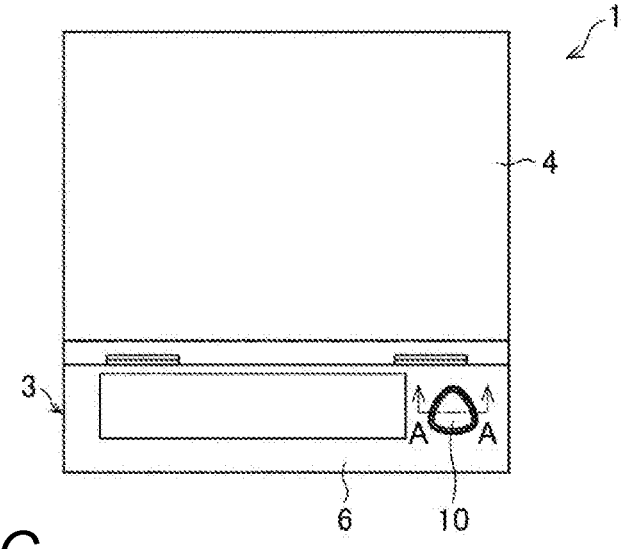
FIG. 1B is a top view of the slot machine.

As illustrated in FIGS. 1A and 1B, in the slot machine 1 as the game machine, a display monitor 2 is provided at a position corresponding to the player's line of sight at the top of a casing 4. An operation unit 3 is provided on the lower front side (player side) of the casing 4 below the display monitor 2. The operation unit 3 is provided on the upper surface of a protruding portion that protrudes forward in the lower portion of the casing 4 and is inclined downward from the rear side toward the front side. The push-button 10 is disposed on the operation unit 3.

As illustrated in FIG. 10, a display device 5 such as a liquid crystal display (LCD) is disposed in the operation unit 3, and a push-button 10 is installed above the display device 5. A transparent plate 6 is disposed above the display device 5 so as to cover a display screen 5*a* of the display device 5, and the push-button 10 is installed so as to be fitted into an opening 6*a* formed in the transparent plate 6.

As illustrated in FIGS. 1A to 10 and FIG. 5, the push-button 10 includes a base 13 and a bezel (frame) 11 and includes a key top (button body) 12 supported therebetween so as to be pressable. The key top 12 includes on its outer periphery an elastic body 14 which is provided in a flange shape integrally with the key top 12 and which has an outer end 142 held between the base 13 and the bezel 11. Further, the key top 12 includes a discharge path 30 that communicates with a space S partitioned by the key top 12, the bezel 11, and the elastic body 14 and discharges liquid that has entered the space S to the outside.

According to such a push-button 10, although liquid enters from between the key top 12 and the bezel 11, the outer end 142 of the elastic body 14 held between the base 13 and the bezel 11 functions as a waterproof packing. The outer end 142 thus prevents the liquid from entering the inside of the base 13 through the gap between the base 13 and the bezel 11. Further, since the elastic body 14 is formed integrally on the key top 12, the liquid does not enter the inside of the base 13 through the joint between the elastic body 14 and the key top 12. Moreover, according to such a push-button 10, since the discharge path 30 discharges the liquid having entered the space S to the outside, it is possible to prevent or reduce the accumulation of the liquid in the space S.

§ 2 Configuration Example (Configuration of Push-Button 10)

Figure 2A:
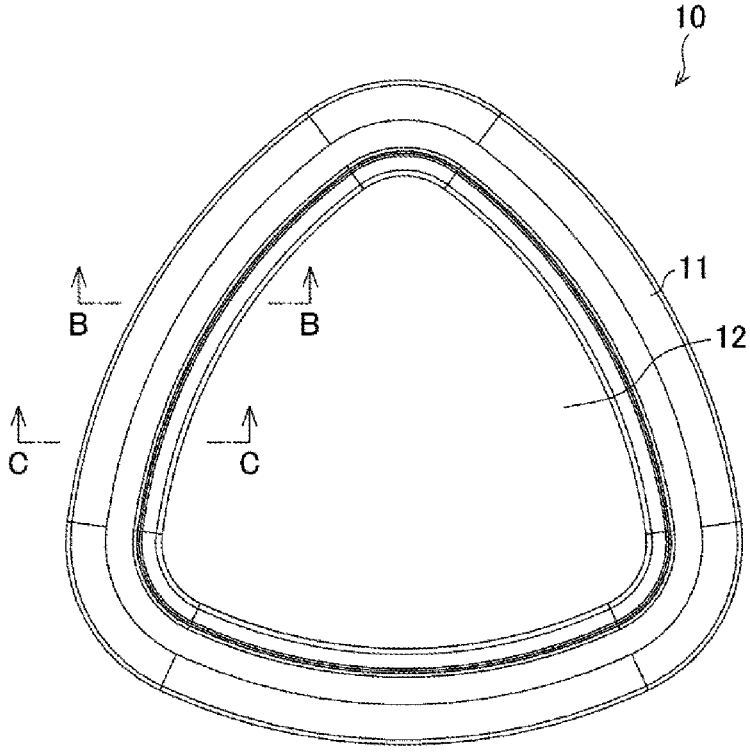
FIG. 2A is a plan view of the push-button.
Figure 2B:
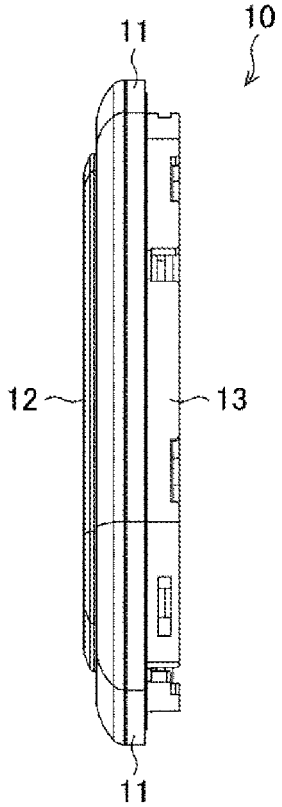
FIG. 2B is a front view of the push-button.
Figure 2C:
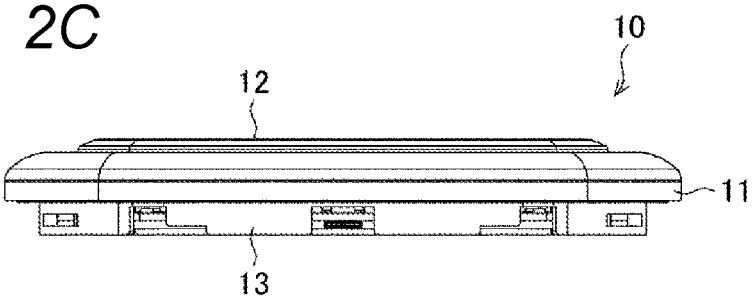
FIG. 2C is a side view of the push-button.

The schematic configuration of the push-button 10 according to one aspect of the present disclosure will be described. FIG. 2A is a plan view of the push-button 10, FIG. 2B is a front view thereof, and FIG. 2C is a side view thereof. As illustrated in FIGS. 2A to 2C, the push-button 10 is a thin push-button having a substantially triangular shape in a plan view. The push-button 10 includes the bezel 11 and the base 13 and includes the key top 12 supported therebetween in a pressable manner. The thickness corresponding to the dimension in the pressing direction of the push-button 10 is designed to be, for example, about 11.5 mm. The shape of the push-button of the present invention in plan view is not limited to a substantially triangular shape.

Figure 3:
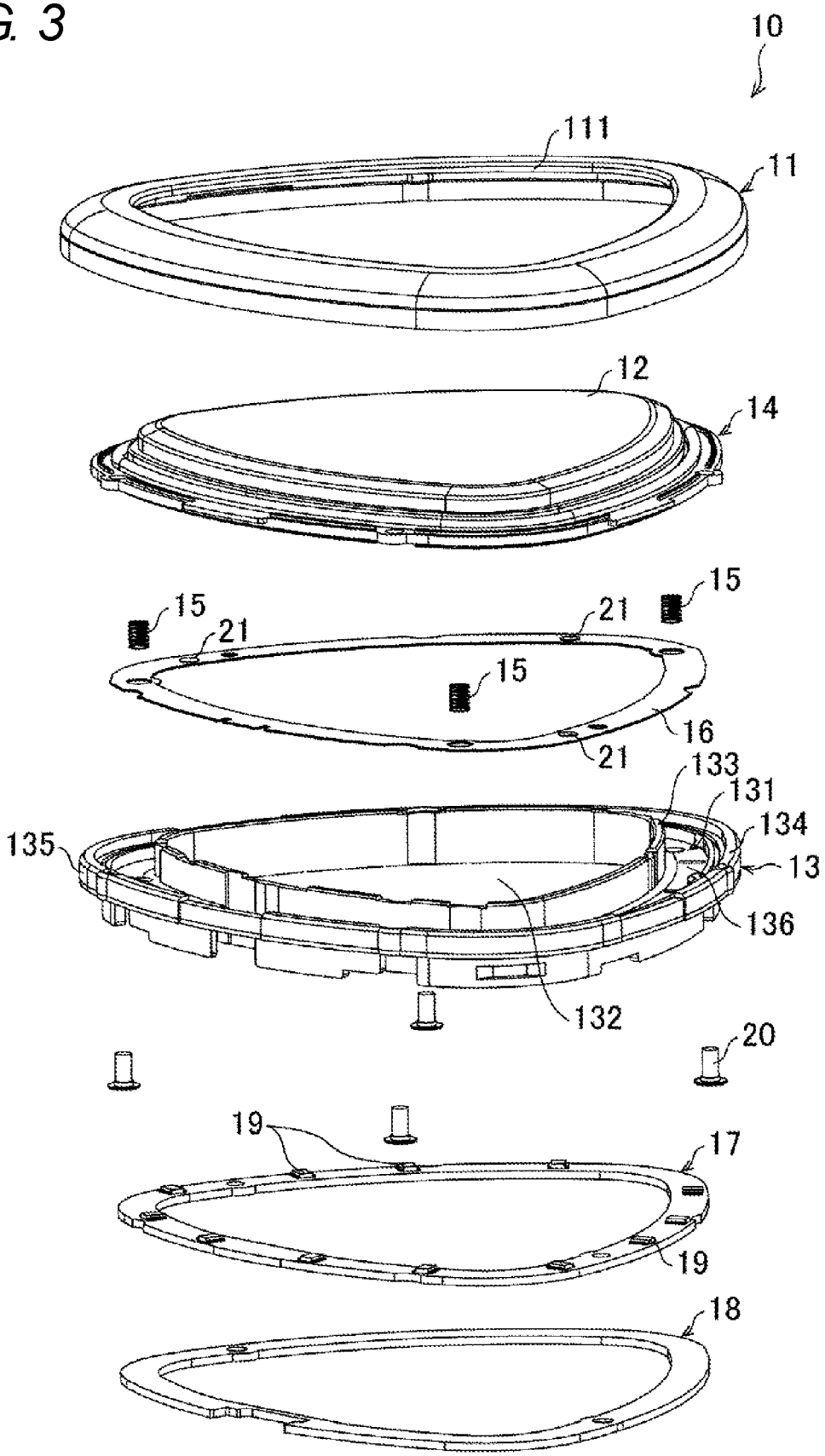
FIG. 3 is an exploded perspective view of the push-button.
Figure 4:
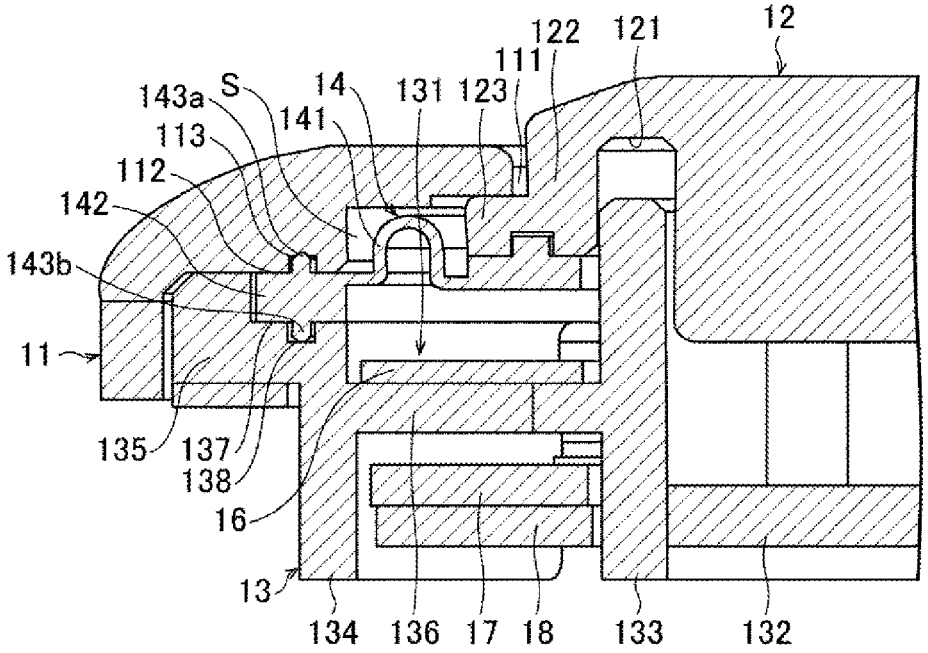
FIG. 4 is a sectional view taken along line B-B of FIG. 2A.
Figure 5:
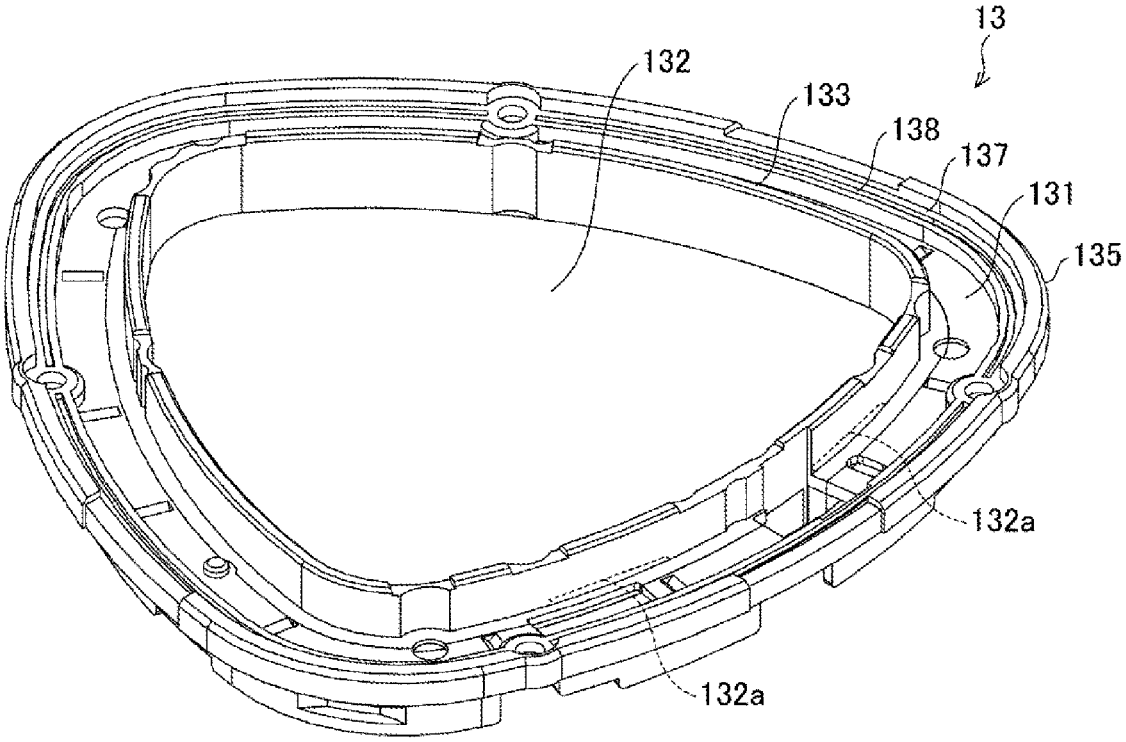
FIG. 5 is a perspective view of the front side of a base provided in the push-button.
Figure 6:
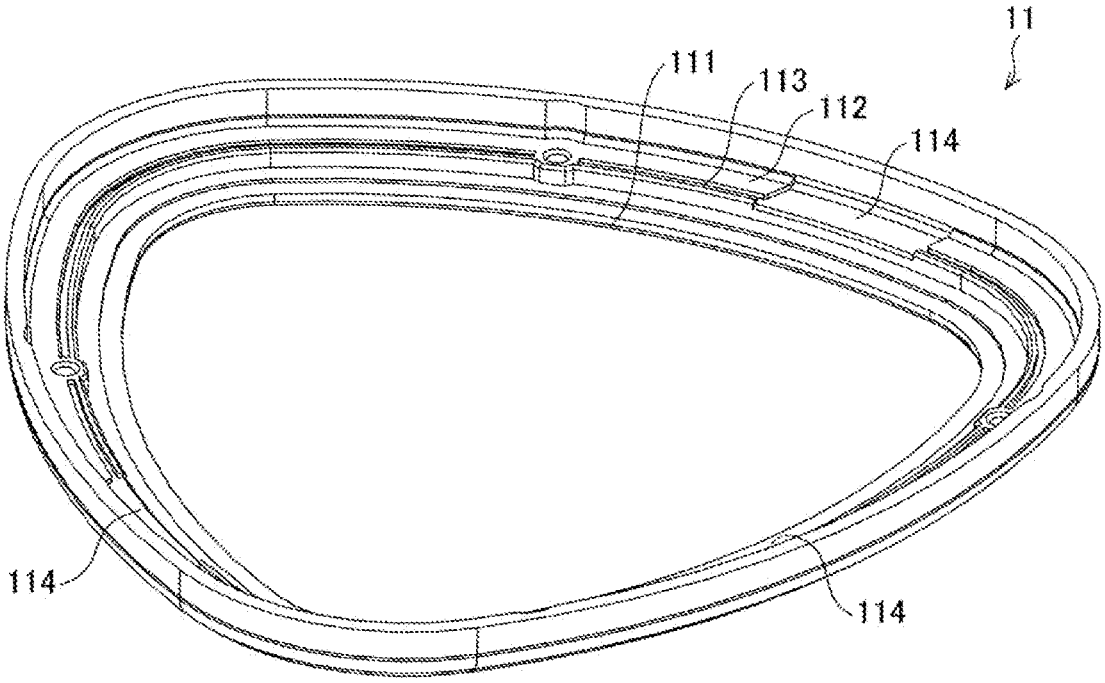
FIG. 6 is a perspective view of the back side of a bezel provided in the push-button.

FIG. 3 is an exploded perspective view of the push-button 10. FIG. 4 is a sectional view taken along line B-B of FIG. 2A. FIG. 5 is a perspective view of the front side of the base 13. FIG. 6 is a perspective view of the back side of the bezel 11.

As illustrated in FIGS. 3 and 4, in addition to the bezel 11, the base 13, and the key top 12 described above, the push-button 10 includes an elastic body 14, a return spring (spring component) 15, a pressing detector 16, a light-emitting diode (LED) substrate 17, a back cover 18, and the like.

The base 13 supports the key top 12 and the bezel 11 and is also a portion attached to the operation unit 3 (see FIG. 10). The base 13 is also a light guide that propagates light that causes the bezel 11 to emit light.

As illustrated in FIG. 5, the base 13 has an H-shaped groove portion 131 having a substantially H-shaped cross section on the outer periphery, and has a visible recognition area portion 132 formed of a transparent material in the central portion inside the H-shaped groove portion 131. An inner wall 133 which is the inner wall of the H-shaped groove portion 131 protrudes upward, and functions as a guide wall for guiding the movement of the key top 12 upon the pressing of the key top 12 and returned (see FIG. 4).

Further, an outer peripheral wall 134 which is also the outer wall of the H-shaped groove portion 131 has at the upper portion a thick portion 135 extending outward, and the thick portion 135 supports the bezel 11 (see FIG. 4). Among these, a bottom wall 136, the outer peripheral wall 134, and the thick portion 135 of the H-shaped groove portion 131 function as a light guide. In the embodiment, a description will be given assuming that the push-button 10 is disposed on a horizontal surface, the pressing direction is a downward direction, and the returning direction is an upward direction. Further, the operated side of the push-button 10 is also referred to as the front side, and the side to be attached is also referred to as the back side.

Further, the base 13 is provided with an air hole 132*a* which allows air to flow into and out of the base 13. In the present embodiment, the air hole 132*a* is formed in each of two locations on the boundary with the inner wall 133 in the visible recognition area portion 132. The air hole 132*a* is not essential but is preferably provided as described later.

As illustrated in FIG. 4, at least the central portion of the key top 12 which faces the visible recognition area portion 132 of the base 13 is made of a transparent material and formed to be thick. The key top 12 has, in the back-surface-side outer periphery, a guide groove 121 with the inner wall 133 of the base 13 put therein. The lower end of an outer peripheral wall 122, which is also the outer wall of the guide groove 121, has a flange portion 123 located above the central portion and extending outward. The elastic body 14 is integrally provided on the lower surface of the flange portion 123.

The key top 12 integrally provided with the elastic body 14 is covered from above the base 13, and is supported by the base 13 so as to be pressable in a state where the inner wall 133 of the base 13 is put in the guide groove 121.

The bezel 11 has translucency and is a cover member for covering (protecting) a part of the upper surface and the side surface of the push-button 10. As illustrated in FIG. 6, the bezel 11 is provided on the outer periphery of the key top 12 and has an opening 111 through which the central portion of the key top 12 moves in the pressing direction. When the key top 12 is not pressed down, the central portion protrudes upward through the opening 111 of the bezel 11 (see FIG. 4). Further, the bezel 11 is a diffusing material and diffuses applied light via the light guiding portion.

Such a bezel 11 is covered from above the base 13 in the state of supporting the key top 12, and is supported by the thick portion 135 of the base 13 in the state of covering the outer peripheral surface of the thick portion 135. The bezel 11 is then fixed to the base 13 with a screw 20 (see FIG. 3) in a state where the outer periphery of the elastic body 14 is held between the bezel 11 and the base 13.

The return spring 15 and a pressing detector 16 are disposed above the H-shaped groove portion 131 of the base 13 as illustrated in FIGS. 3 and 4. The return spring 15 is a member for returning the pressed key top 12 to the original state. Three return springs 15 are disposed between the bottom wall 136 of the H-shaped groove portion 131 and the flange portion 123 of the key top 12 (via the elastic body 14). The pressing detector 16 is an electrical component that includes a press sensor (pressure sensing unit) 21 and detects the pressing of the key top 12. In the example of FIG. 3, three press sensors 21 are disposed.

The LED substrate 17 and the back cover 18 are disposed in the space under the H-shaped groove portion 131 of the base 13. The LED substrate 17 is an electrical component provided with a plurality of LEDs (light sources) 19 for causing the push-button 10 to emit light. The light of the LED 19 is transmitted from the bottom wall 136 to the bezel 11 via the outer peripheral wall 134 and the thick portion 135, and the bezel 11 emits light. The back cover 18 closes the space under the H-shaped groove portion 131.

The elastic body 14 is provided in a flange shape integrally with the key top 12 on the lower surface of the flange portion 123 on the outer periphery of the key top 12. The elastic body 14 prevents liquid having entered from between the key top 12 and the bezel 11 from entering the inside of the base 13. Although a detail will be described later, as illustrated in FIG. 4, the outer end 142 of the elastic body 14 is formed to be thick, and the outer end 142 is held between the base 13 and the bezel 11 to function as a waterproof packing.

Figure 7:
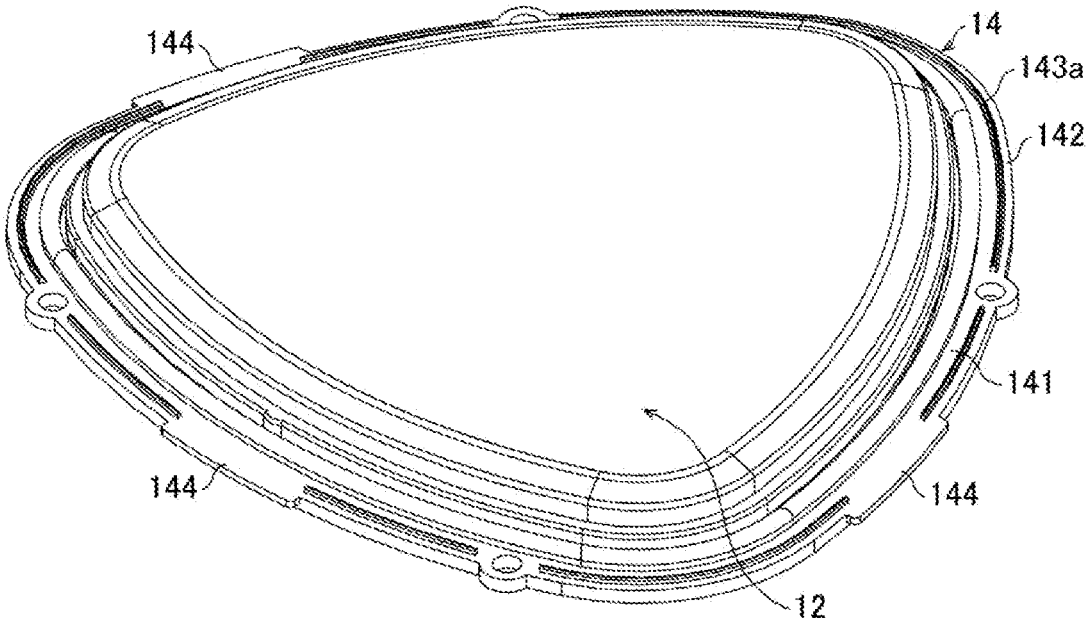
FIG. 7 is a perspective view of the front sides of a key top and an elastic body provided on the push-button.
Figure 8:
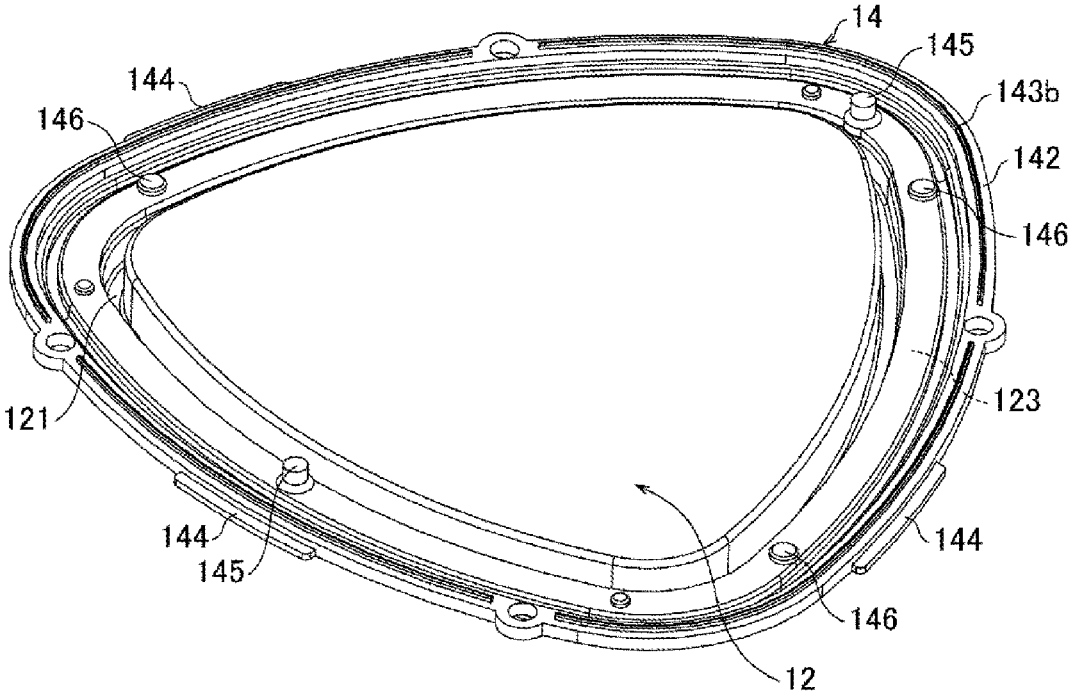
FIG. 8 is a perspective view of the back sides of the key top and an elastic body provided on the push-button.

FIG. 7 is a perspective view of the front sides of the key top 12 and the elastic body 14. FIG. 8 is a perspective view of the back sides of the key top 12 and the elastic body 14. As illustrated in FIGS. 7 and 8, the elastic body 14 has a thin-walled bent portion 141 that is bent so as to be convex on the front side between the portion attached to the key top 12 and the outer end 142. The bent portion 141 is a portion that generates a space for preventing the elastic body 14 from being stretched upon the pressing of the key top 12 to inhibit the operability (see FIG. 10B). The bent portion 141 is formed over the entire circumference of the elastic body 14.

Further, as illustrated in FIG. 8, the back surface of the elastic body 14 is provided with a press portion 146 that contacts the press sensor 21 of the pressing detector 16 and a click generator 145 that gives a click feeling by deforming upon the pressing of the key top 12. In the embodiment, the press portions 146 are provided in three locations corresponding to the press sensor 21, and the click generators 145 are disposed in two locations which are the vertex of the substantial triangle and the central portion of the side facing the vertex.

Figure 9A:
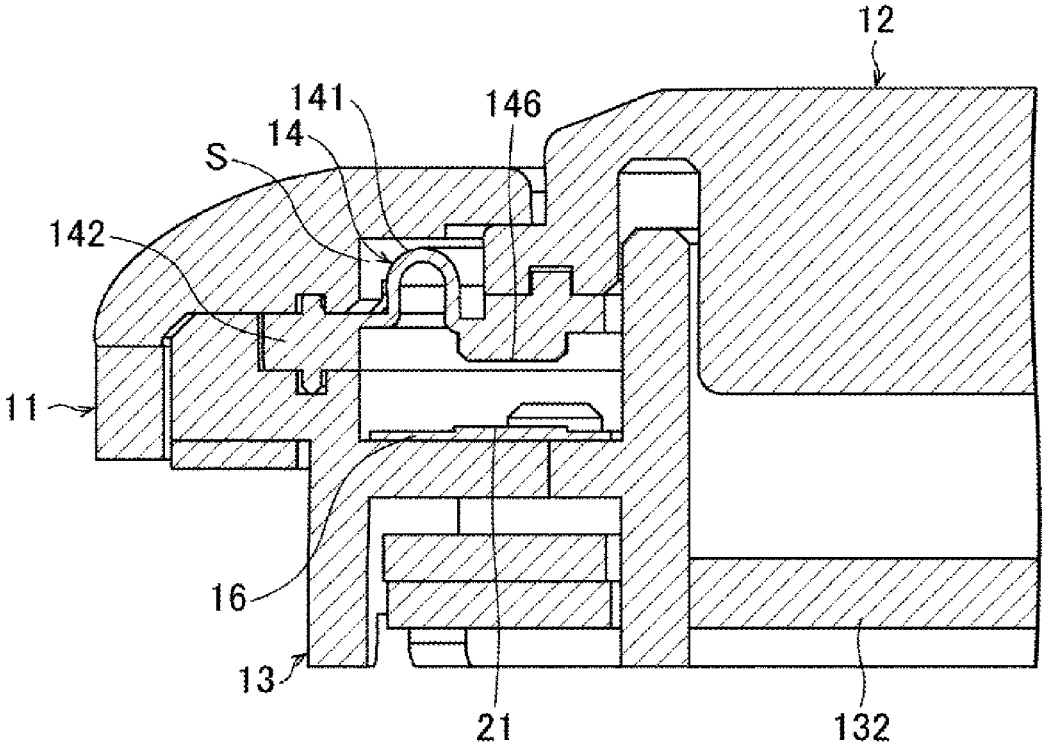
FIG. 9A is a sectional view of a main part around a press portion, illustrating a state before pressing in the push-button.
Figure 9B:
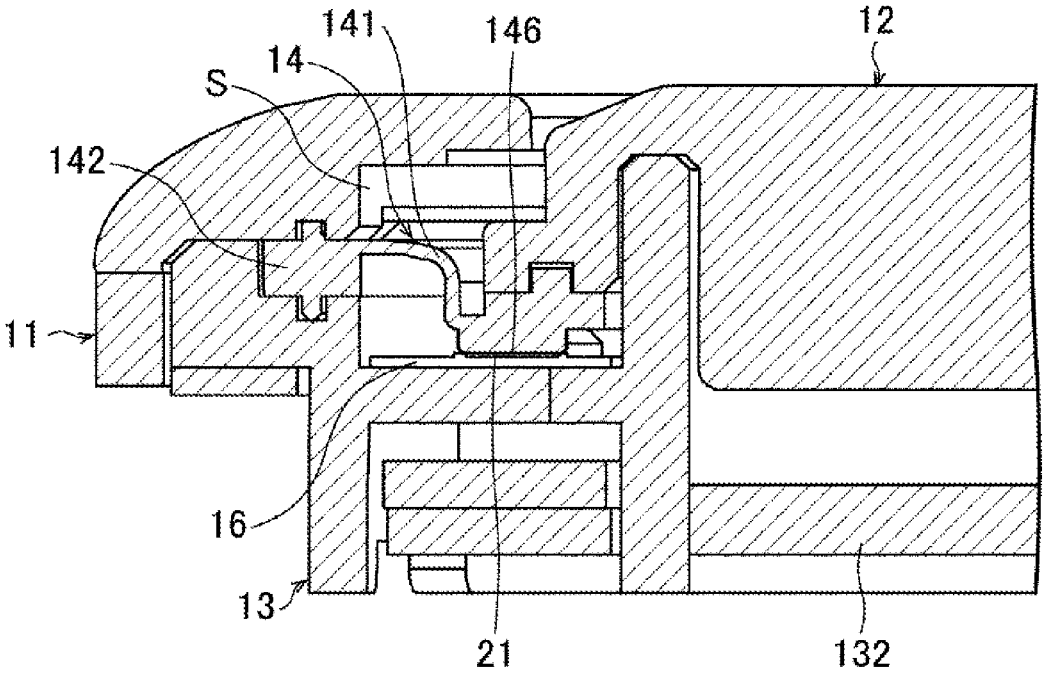
FIG. 9B is a sectional view of the main part around the press portion, illustrating a pressed state.

FIG. 9A is a sectional view of a main part around the press portion 146, illustrating a state before the pressing in the push-button 10, and FIG. 9B is a sectional view of the main part around the press portion 146, illustrating a pressed state. As illustrated in FIGS. 8A and 8B, the press portion 146 contacts the press sensor 21 of the pressing detector 16 upon the pressing of the key top 12, and the pressing detector 16 detects that the player has pressed the key top 12. The result detected by the pressing detector 16 is output to the controller of the push-button 10 or the controller of the slot machine 1, not illustrated.

Figure 10A:
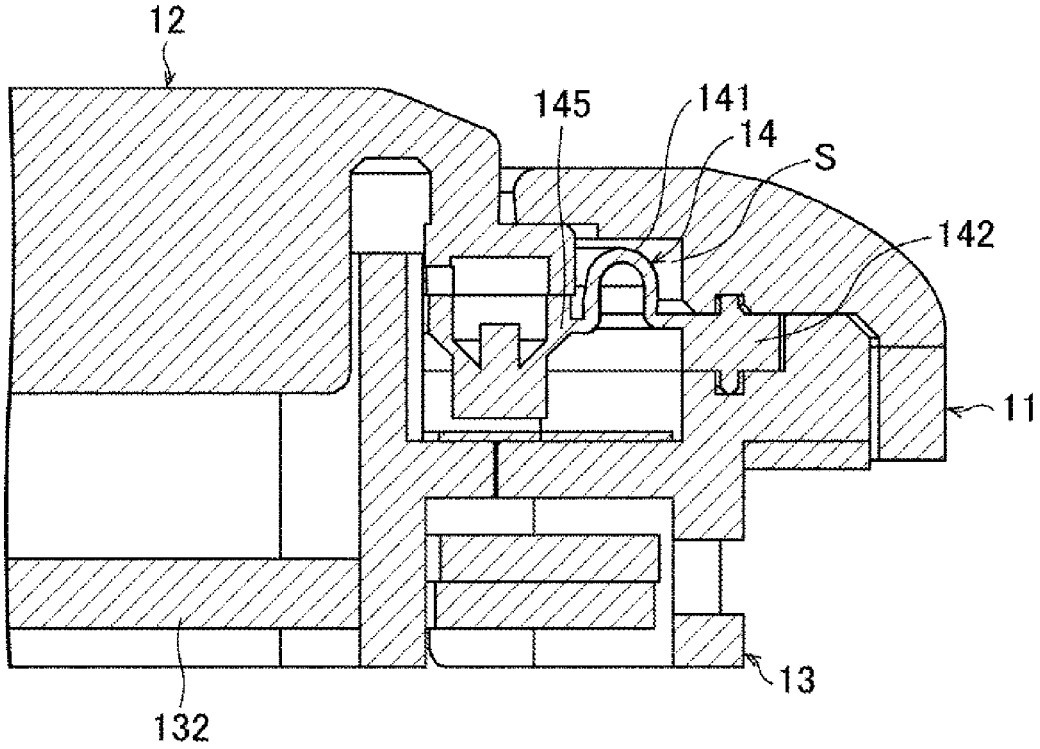
FIG. 10A is a sectional view of a main part around a click generator, illustrating a state before the pressing in the push-button.
Figure 10B:
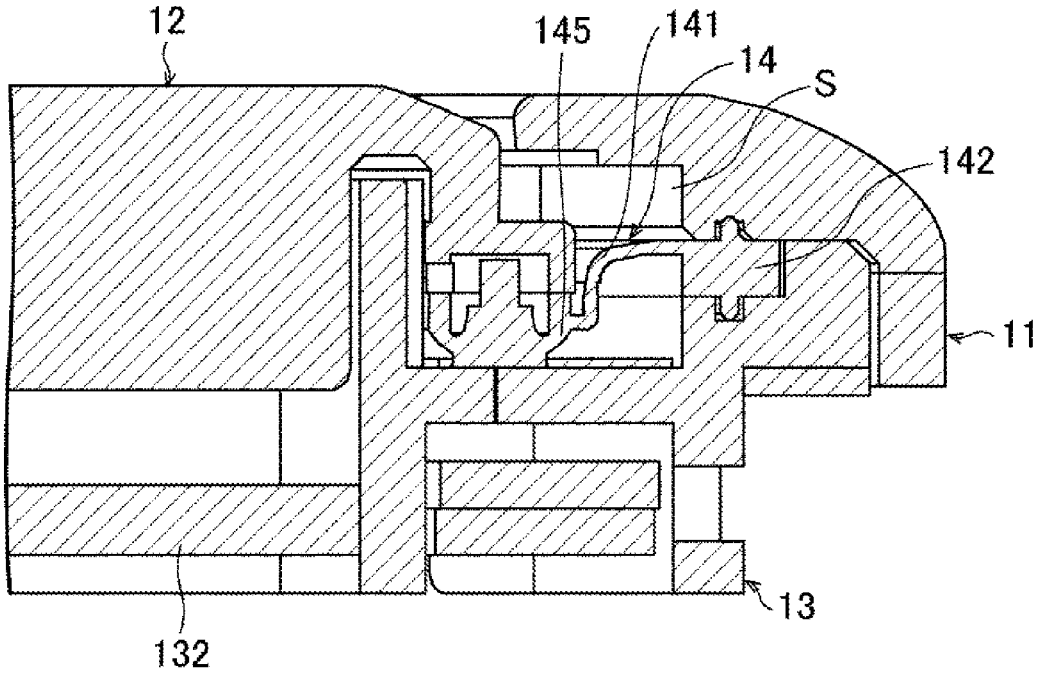
FIG. 10B is a sectional view of the main part around the click generator, illustrating a pressed state.

FIG. 10A is a sectional view of a main part around the click generator 145, illustrating a state before the pressing in the push-button 10, and FIG. 10B is a sectional view of the main part around the click generator 145, illustrating a pressed state. As illustrated in FIGS. 10A and 10B, the click generator 145 deforming along with the pressing operation of the key top 12, when the player presses the key top 12, the click generator 145 can give a click feeling to the player.

As thus described, by utilizing the elastic body 14 being formed of an elastic member, the press portion 146 and the click generator 145 are integrally formed on the elastic body 14, so that it is possible to reduce the cost and the number of components.

(Waterproof Structure of Push-Button 10)

Next, the waterproof structure of the push-button 10 will be described with reference to FIGS. 4 to 8 and FIG. 11. As illustrated in FIG. 4, the elastic body 14 is provided in a flange shape integrally with the key top 12 on the lower surface of the flange portion 123 on the outer periphery of the key top 12. As a method of integrally providing the elastic body 14 with the key top 12, for example, adhesion or two-color molding can be used. Other methods may be used.

The elastic body 14 has the outer end 142 formed to be thick, and the outer end 142 is received by a receiving portion 137 (see FIG. 5) formed on the thick portion 135 of the base 13. As illustrated in FIG. 5, the receiving portion 137 is a step in which the outer end 142 fits. The step of the receiving portion 137 is formed to have a height smaller than the thickness of the outer end 142 so that the outer end 142 can be held while being applied with pressure between the receiving portion 137 and a holding surface 112 of the bezel 11.

The holding surface 112 (see FIG. 6) of the bezel 11 is in contact with the front side of the outer end 142. The holding surface 112 is formed of a flat surface, and is formed of a flat surface covering the upper surface of the thick portion 135 of the base 13, including the outer side of the receiving portion 137.

The outer end 142 is applied with pressure and held between the receiving portion 137 and the holding surface 112 and functions as a waterproof packing.

Figure 11:
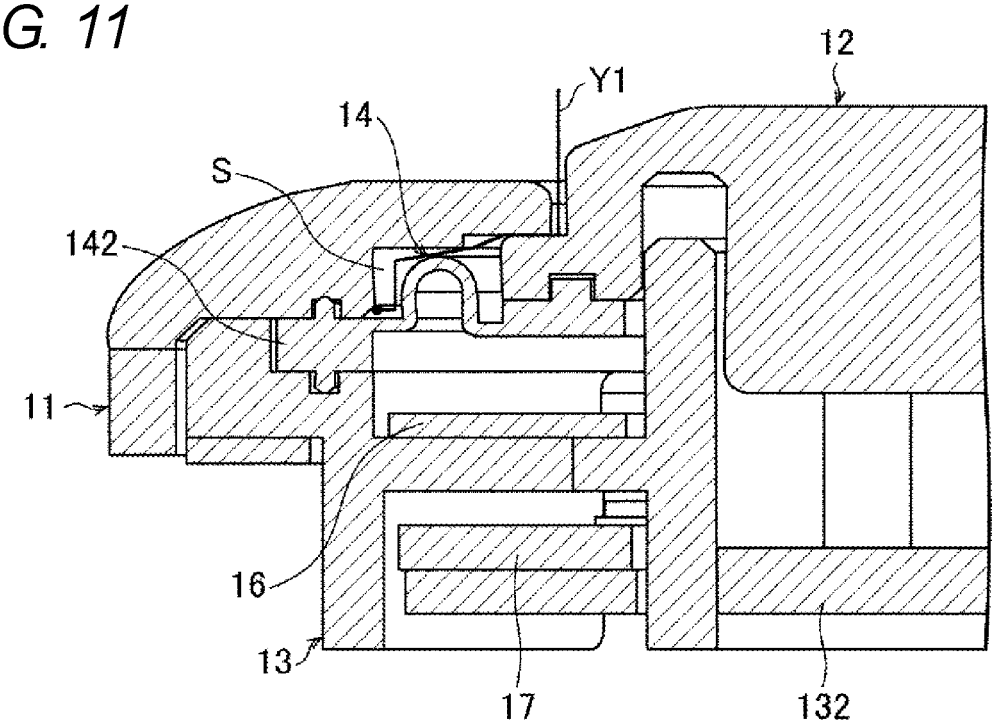
FIG. 11 is a sectional view of the main part, illustrating a state in which liquid having entered from between the key top and the bezel in the push-button is prevented from entering the inside of the base.

FIG. 11 is a sectional view of the main part illustrating a state in which liquid having entered from between the key top 12 and the bezel 11 is prevented from entering the inside of the base 13. As illustrated in FIG. 11, when the liquid is spilled on the push-button 10, the liquid enters the space S, partitioned by the key top 12, the bezel 11, and the elastic body 14, from between the key top 12 and the bezel 11. An arrow Y1 indicates the entry path. However, since there is no gap between the key top 12 and the elastic body 14 which are formed integrally, no liquid enters the inside of the base 13 from between the key top 12 and the elastic body 14. Further, since the outer end 142 functions as a waterproof packing, the liquid does not enter the inside of the base 13 from the gap between the base 13 and the bezel 11.

It is thereby possible to prevent the liquid from contacting the electrical components such as the pressing detector 16 and the LED substrate 17 disposed inside the base 13. In addition, it is possible to inhibit the entry of the liquid into the visible recognition area portion 132 of the push-button 10, and prevent the loss of the visibility of the image displayed on the display device (see FIG. 10) through the key top 12.

Further, in the embodiment, as a more preferable configuration, a first rib 143*a* is formed on the front surface side of the outer end 142, and a second rib 143*b* is formed on the back-surface side of the outer end 142. As illustrated in FIG. 7, the first rib 143*a* is formed along the shape of the outer end 142 except for a discharge port 144 communicating with the later-described discharge path 30 and an insertion hole of the screw 20 (see FIG. 3). As illustrated in FIG. 8, the second rib 143*b* is formed along the shape of the outer end 142 except for the insertion hole of the screw 20 (see FIG. 3).

In accordance with the first rib 143*a*, a first rib receiving groove 113 (see FIG. 6) in which the first rib 143*a* is fitted is formed on the holding surface 112 of the bezel. In accordance with the second rib 143*b*, a second rib receiving groove 138 (see FIG. 5) in which the second rib 143*b* is fitted is formed in the receiving portion 137 of the base 13. In the embodiment, the rib and the rib receiving groove are provided on both the front and back surfaces of the outer end 142, but at least the first rib 143*a* and the first rib receiving groove 113 may be provided.

As illustrated in FIG. 10B, even when the shape of the elastic body 14 changes with the pressing of the key top 12, the shapes of the first rib 143*a* and the second rib 143*b* are maintained. As a result, even when the elastic body deforms with the pressing of the key top 12, it is possible to stably maintain the waterproofness. Specifically, at this time, a force in the direction away from the holding surface 112 is applied to the outer end 142 on the bezel 11 side. Even when such a force is applied, the sealing ability is maintained by the first rib 143*a*, and the waterproofness can be enhanced.

More preferably, both the first rib 143*a* and the second rib 143*b* are provided. Thereby, even when the sealing ability by the first rib 143*a* is broken, the sealing ability is maintained by the second rib 143*b*, and the waterproofness can be enhanced. The second rib 143*b* is strongly pressed against the second rib receiving groove 138 at the time of pressing, so that the sealing ability between the outer end 142 and the receiving portion 137 is more reliably maintained.

Further, in the push-button 10 provided with such an elastic body 14, when the key top 12 is returned, air is sucked into the base 13 with a strong force through any gap. Therefore, if a portion with a weak sealing ability is generated due to aging, there is a possibility that liquid may be sucked into the base 13 together with the air from that portion. In the embodiment, as described above, with the air holes 132*a* being provided in the base 13, even when a portion with a weak sealing ability is generated due to aging, it is possible to effectively prevent the suction of liquid caused by negative pressure when the key top 12 is returned. In addition, the return of the key top 12 also becomes smooth.

(Discharge Path of Push-Button 10)

Figure 12:
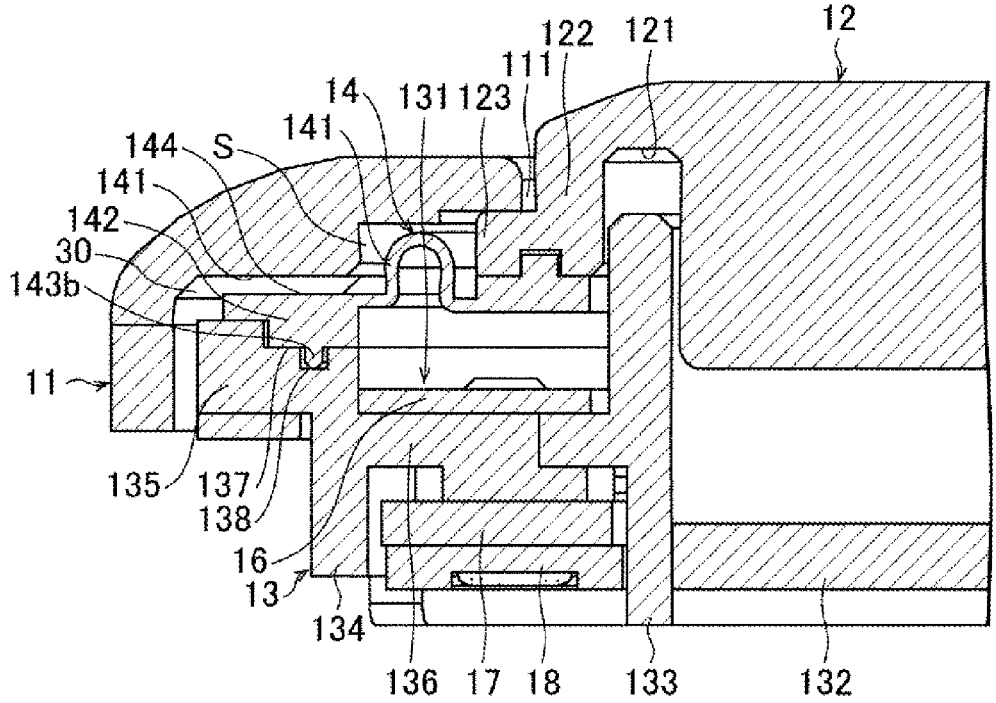
FIG. 12 is a sectional view taken along line C-C of FIG. 2A.

Next, the discharge path of the push-button 10 will be described with reference to FIGS. 5 to 8 and 12 to 14. FIG. 12 is a sectional view taken along line C-C of FIG. 2A. As illustrated in FIG. 12, the push-button 10 communicates with the space S and includes the discharge path 30 for discharging the liquid having entered the space S to the outside. The discharge path 30 includes a discharge recess 114 (see FIG. 6) formed on the holding surface 112 in the bezel 11 which is in contact with the outer end 142, and a discharge groove portion 139 formed on the base 13, corresponding to the discharge recess 114 (see FIG. 5). The discharge recess 114 is formed corresponding to the discharge port 144 formed in the elastic body 14. Since the discharge port 144 is provided in each of three locations in the elastic body 14 as illustrated in FIG. 7, the discharge groove portion 139 and the discharge recess 114 are also formed in three locations as illustrated in FIGS. 5 and 6.

Figure 13:
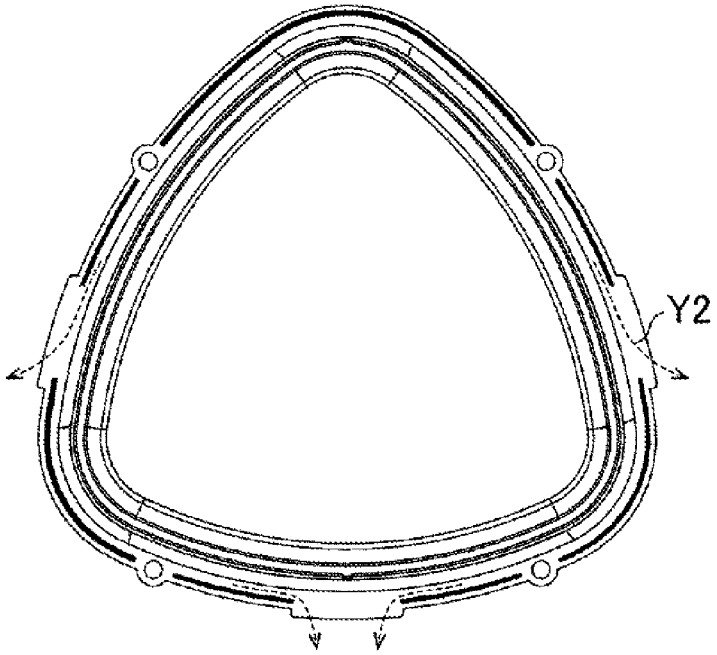
FIG. 13 is a plan view of the key top and the elastic body, illustrating a discharge path in the push-button.

FIG. 13 is a plan view of the key top 12 and the elastic body 14, illustrating the discharge path 30 in the push-button 10. As illustrated in FIG. 13, the liquid having entered from between the key top 12 and the bezel 11 travels along the front surface side (the bezel 11 side) of the elastic body 14 and flows into the discharge port 144 as illustrated by an arrow Y2. Since the discharge port 144 is provided in each of three locations in the elastic body 14, the liquid is discharged through the three locations.

Figure 14:
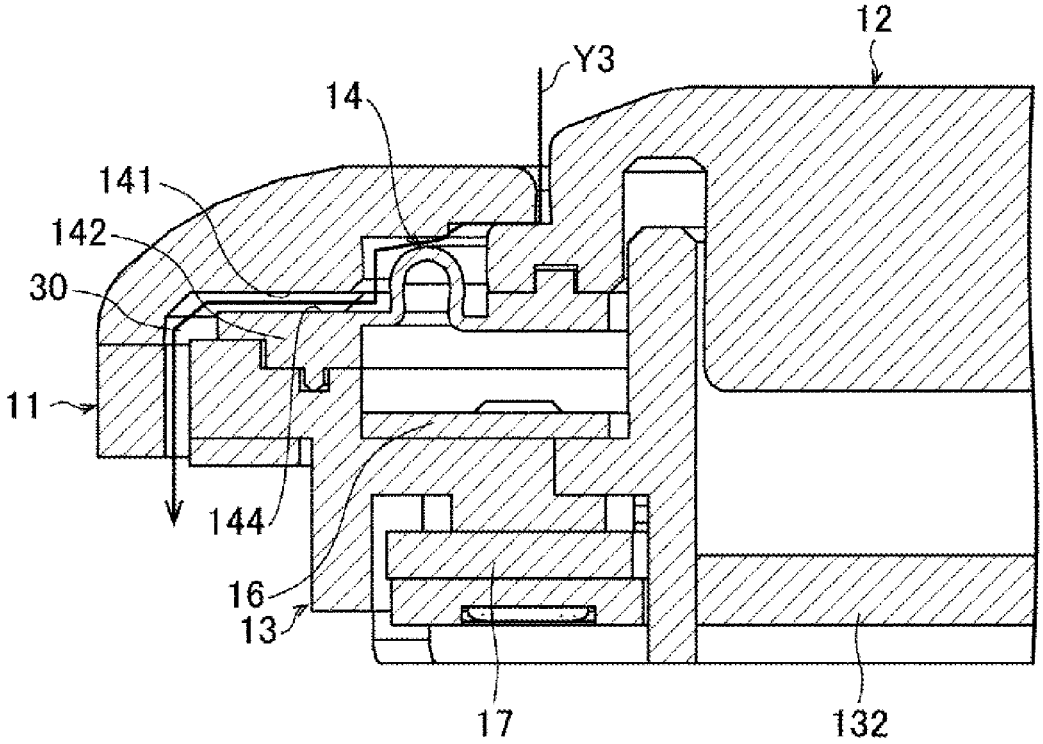
FIG. 14 is a sectional view of the main part, illustrating a path for discharging the liquid, having entered from between the key top and the bezel, to the outside by using the discharge path in the push-button.
Figure 15A:
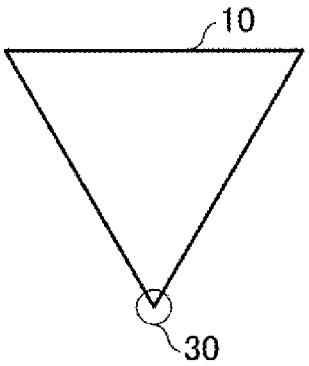
FIGS. 15A to 15D are explanatory views illustrating variations of the shape of the push-button in plan view and the position where the discharge path is provided.
Figure 15B:
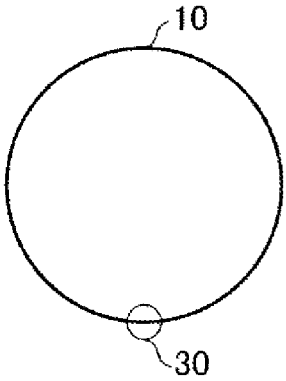
Figure 15C:
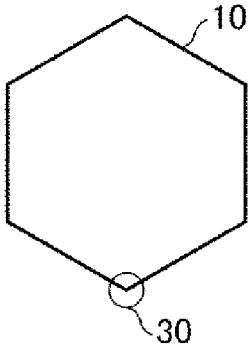
Figure 15D:
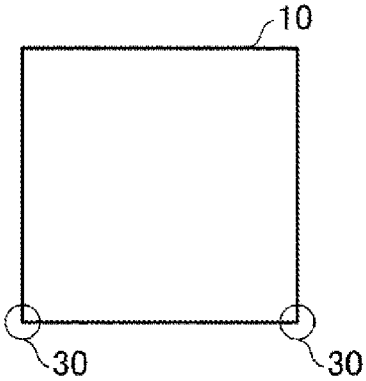

FIG. 14 is a sectional view of the main part, illustrating a path for discharging the liquid, having entered from between the key top 12 and the bezel 11, to the outside by using the discharge path 30. As illustrated in FIG. 14, when liquid is spilled on the push-button 10, the liquid enters the space S, partitioned by the key top 12, the bezel 11, and the elastic body 14, from between the key top 12 and the bezel 11. The liquid having entered the space S is discharged to the outside through the discharge path 30 as indicated by an arrow Y3.

By the elastic body 14 blocking the entry path of the fluid into the base 13, it is possible to prevent the liquid from entering the inside of the base 13. However, if the liquid remaining in the space S partitioned by the key top 12, the bezel 11, and the elastic body 14 contains sugar, the liquid becomes viscous to inhibit the operability of the key top 12.

The push-button 10 includes, in addition to the elastic body 14, the discharge path 30 communicating with the space S and discharging the liquid having entered the space S to the outside, so the liquid is discharged to the outside via the discharge path 30 without accumulating in the space S. This can minimize a problem that the spilled liquid becomes viscous to inhibit the operability of the key top 12.

In the embodiment, the discharge groove portion 139 (see FIG. 5) is formed in the base 13, corresponding to the discharge recess 114 on the bezel 11 side. However, the discharge groove portion 139 may be formed on the bezel 11 side or can also be provided on each of the base 13 and the bezel 11. Providing the recess in each of the base 13 and the bezel 11 can facilitate the formation of the discharge path.

§ 3 Modifications

In the above embodiment, the configuration has been exemplified where the discharge paths 30 are provided in the three locations in the push-button 10 having a substantially triangular shape in a plan view. However, for example, as illustrated in FIGS. 15A to 15D, the present invention may be applied to a push-button having a round, polygonal, or rectangular shape, or some other shape. The circled position in each shape is preferred as the location where the discharge path 30 is provided. By providing the discharge path 30 at the corner, even when the push-button is attached to the horizontal surface, the liquid can be discharged effectively.

Figure 16:
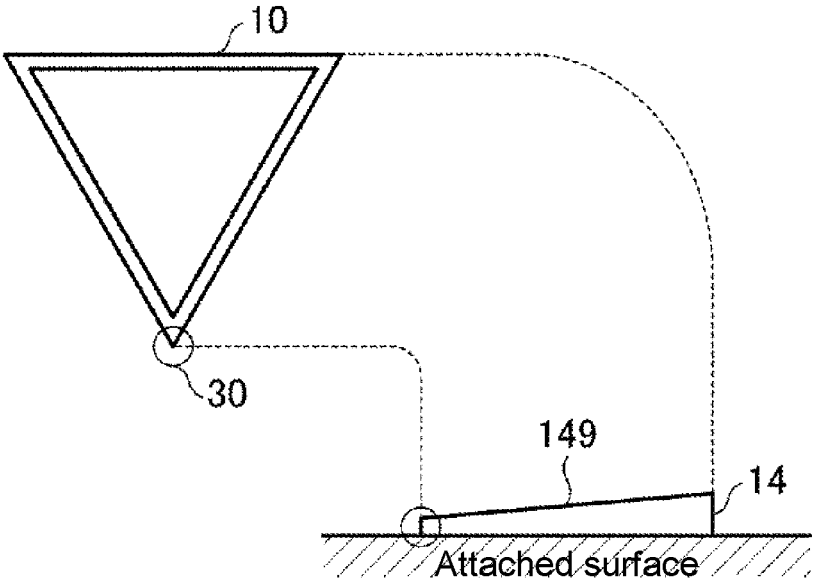
FIG. 16 is a view illustrating a modification of the push-button, the view illustrating a configuration in which a slope is provided on the front-side surface of the elastic body.

Further, when the push-button 10 is disposed on the horizontal plane as illustrated in FIG. 16, the surface on the front side (the bezel 11 side) of the elastic body 14 has a slope 149 which becomes lower toward the discharge path 30. As a result, even when the push-button 10 is disposed on the horizontal surface, it is possible to guide the liquid having entered the space S to the discharge path 30 and make it difficult for the liquid to remain.

Figure 1C:
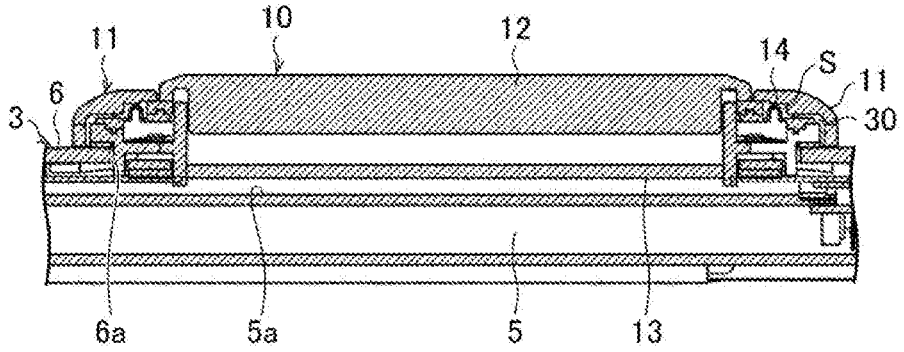
FIG. 1C is a sectional view taken along line A-A of FIG. 1B.

Although not illustrated, in order to prevent the liquid discharged from the push-button 10 from entering the inside of the back surface side of the push-button 10 through the opening 6*a* formed in the transparent plate 6 illustrated in FIG. 1, it is preferable to provide a second packing made of sponge or rubber at the lower portion on the outer periphery of the base 13.

The invention claimed is:

1. A push-button for a game machine, the push-button comprising:

a base;

a button body supported by the base so as to be pressable;

a spring component disposed between the base and the button body and configured to return the button body pressed;

a frame having, inside, an opening through which a central portion of the button body moves in a pressing direction, the frame covering an outer periphery of the button body from an opposite side of the base and being fixed to the base;

an elastic body provided over an entire circumference of the button body and configured to be held between the base and the frame to prevent a liquid from entering an inside of the base; and a discharge path configured to communicate with a space partitioned by the button body, the frame, and the elastic body, the discharge path being configured to discharge the liquid entering the space to the outside.

2. The push-button for a game machine according to claim 1, wherein the discharge path includes a recess formed in an area in the frame, the area being in contact with an outer end of the elastic body, and a groove portion formed in a location in the base, the frame, or both, the location corresponding to the recess.

3. The push-button for a game machine according to claim 1, further comprising:

a first rib formed on a surface of an outer end of the elastic body on the frame side; and a first rib receiving groove that is formed in the frame and in which the first rib is fitted.

4. The push-button for a game machine according to claim 3, further comprising:

a second rib formed on a surface of an outer end of the elastic body on the base side; and a second rib receiving groove that is formed in the base and in which the second rib is fitted.

5. The push-button for a game machine according to claim 1, further comprising a click generator formed integrally on the elastic body and configured to give a click feeling by deforming upon pressing of the button body.

6. The push-button for a game machine according to claim 1, further comprising:

a pressing detector which is disposed in the pressing direction of the button body and detects that pressing of the button body; and a press portion formed integrally on the elastic body and contacting a sensor of the pressing detector upon the pressing of the button body.

7. The push-button for a game machine according to claim 1, further comprising, on a frame-side surface of the elastic body, a slope that becomes lower toward the discharge path.

8. The push-button for a game machine according to claim 1, further comprising an air hole formed on the base and configured to allow air to flow into and out of the base.

9. The push-button for a game machine according to claim 2, further comprising:

a first rib formed on a surface of an outer end of the elastic body on the frame side; and a first rib receiving groove that is formed in the frame and in which the first rib is fitted.

10. The push-button for a game machine according to claim 9, further comprising:

a second rib formed on a surface of an outer end of the elastic body on the base side; and a second rib receiving groove that is formed in the base and in which the second rib is fitted.

11. The push-button for a game machine according to claim 2, further comprising a click generator formed integrally on the elastic body and configured to give a click feeling by deforming upon pressing of the button body.

12. The push-button for a game machine according to claim 3, further comprising a click generator formed integrally on the elastic body and configured to give a click feeling by deforming upon pressing of the button body.

13. The push-button for a game machine according to claim 4, further comprising a click generator formed integrally on the elastic body and configured to give a click feeling by deforming upon pressing of the button body.

14. The push-button for a game machine according to claim 9, further comprising a click generator formed integrally on the elastic body and configured to give a click feeling by deforming upon pressing of the button body.

15. The push-button for a game machine according to claim 10, further comprising a click generator formed integrally on the elastic body and configured to give a click feeling by deforming upon pressing of the button body.

* * * * *